United States Patent [19]

Sutter

[11] 4,157,000

[45] Jun. 5, 1979

[54] MOUNTING DEVICE FOR CEILING MEMBERS

[75] Inventor: Ormond S. Sutter, Placentia, Calif.

[73] Assignee: General Electric Company, Schenectady, N.Y.

[21] Appl. No.: 859,062

[22] Filed: Dec. 8, 1977

[51] Int. Cl.[2] ..... E04B 5/55

[52] U.S. Cl. ..... 52/489

[58] Field of Search ..... 52/489, 475, 476, 484, 52/495

[56] References Cited

U.S. PATENT DOCUMENTS

| | | | |
|---|---|---|---|
| 3,807,114 | 4/1974 | Ollinger | 52/489 |
| 4,041,668 | 8/1977 | Jahn et al. | 52/489 |

FOREIGN PATENT DOCUMENTS

| | | | |
|---|---|---|---|
| 1204801 | 11/1965 | Fed. Rep. of Germany | 52/489 |
| 658374 | 10/1951 | United Kingdom | 52/489 |
| 925962 | 5/1963 | United Kingdom | 52/489 |
| 1098613 | 1/1968 | United Kingdom | 52/489 |

*Primary Examiner*—J. Karl Bell

*Attorney, Agent, or Firm*—Sidney Greenberg

[57] ABSTRACT

Elongated adaptor strip with punched-out tabs secures decorative panels to existing ceiling grid support members. Opposite flanges at the open top of channel-shaped elongated decorative panels readily engage pairs of spaced tabs arranged along the length of adaptor strip having C-shaped cross-section which clips onto bottom flange of installed ceiling grid support members.

7 Claims, 5 Drawing Figures

MOUNTING DEVICE FOR CEILING MEMBERS

The present invention relates to ceiling systems, and more particularly concerns a mounting device for attaching decorative panels to a ceiling grid.

It is an object of the invention to provide a mounting device of the above type which enables ready attachment of decorative panels to ceiling grid support members of existing ceilings for enchancing the appearance of such ceilings.

Another object of the invention is to provide a mounting device of the above type which does not interfere with lighting and air conditioning systems associated with the ceiling on which the device is installed.

Still another object of the invention is to provide a ceiling panel mounting device by means of which the ceiling panels may be arranged in various patterns on existing ceiling installations.

Other objects and advantages will become apparent from the following description and the appended claims.

With the above objects in view, the present invention in one of its aspects relates to a mounting device for attaching elongated ceiling panels to an installed ceiling grid system having elongated grid support members formed with a horizontal bottom flange, the device comprising an elongated clip member of generally C-shaped cross -section having an upper arm portion and a lower arm portion joined by a bight portion and adapted to engage the bottom flange of a grid support member with the flange between the arm portions, the lower arm portion having a plurality of pairs of longitudinally spaced, depending tabs punched out therefrom along its length, each pair of tabs adapted to engage an elongated ceiling panel for holding the same below and extending transverse the grid support member.

The invention will be better understood from the following description taken in conjunction with the accompanying drawings, in which.

Figure 1:
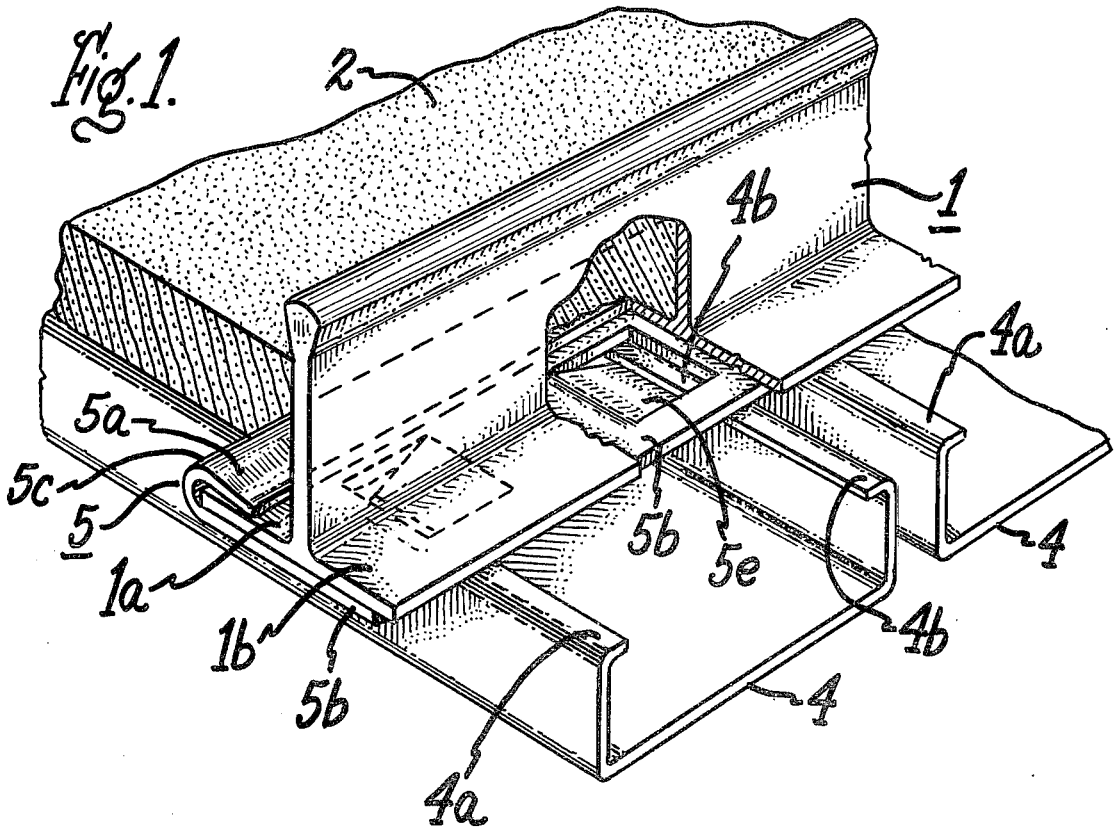
FIG. 1 is a perspective view of a portion of a ceiling grid support system having elongated decorative panels secured to a grid support member by an attachable mounting device in accordance with the invention.
Figure 2:
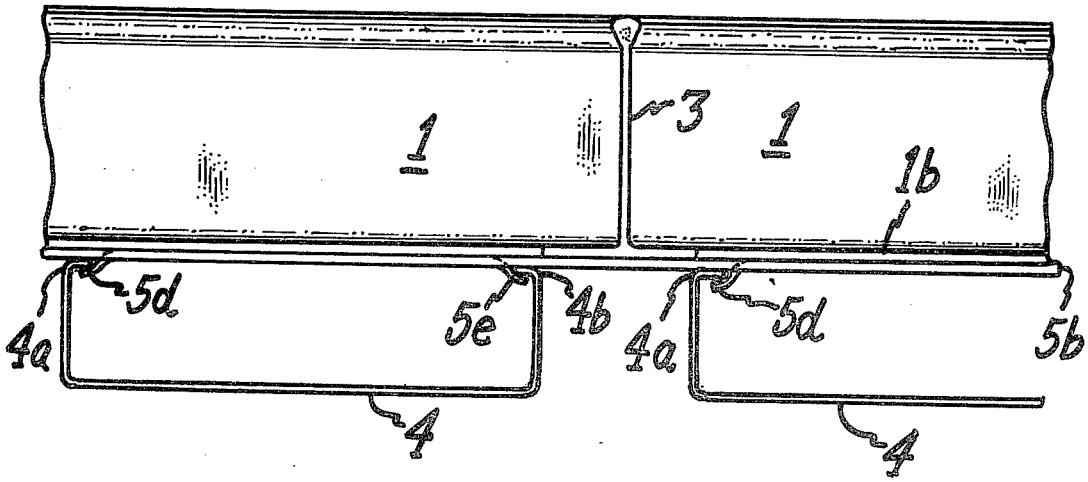
FIG. 2 is an elevational view of the arrangement shown in FIG. 1 taken in the longitudinal direction of the decorative panels.
Figure 3:
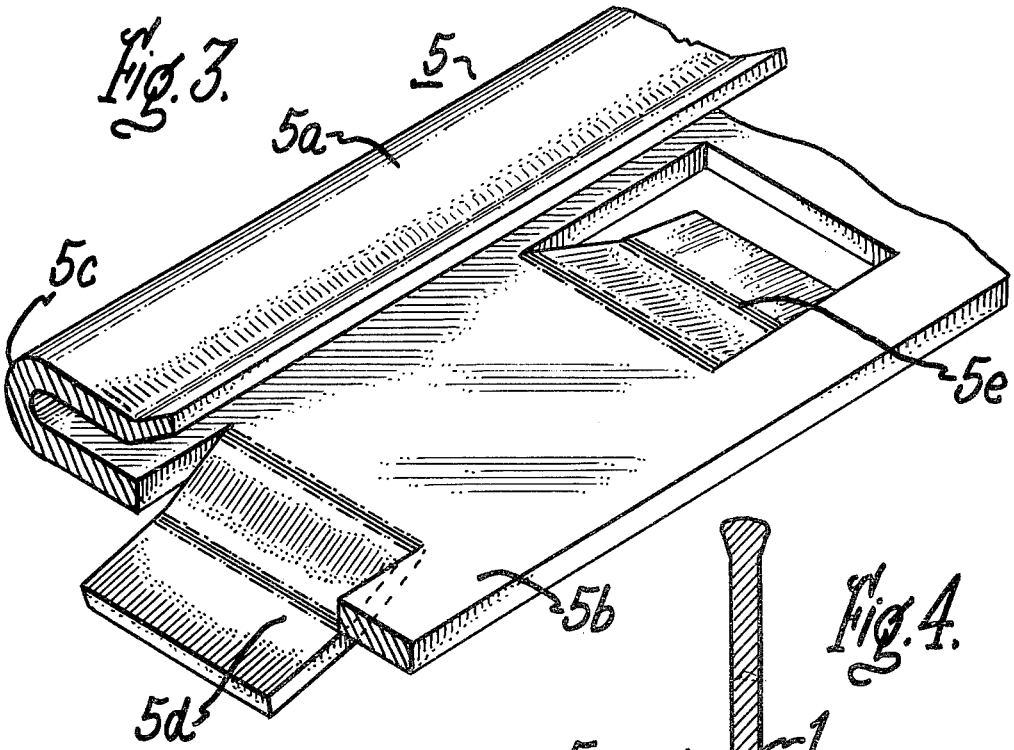
FIG. 3 is a perspective view of the mounting device shown in FIGS. 1 and 2.

Referring now to the drawing, and particularly to FIG. 1, there is shown a portion of a ceiling grid system including an elongated grid support member 1 of inverted T-shaped cross-section having horizontal bottom flanges 1*a*, 1*b* on which ceiling tiles 2 are supported in conventional manner. For the purpose of readily attaching elongated decorative panels 4, such as channel-shaped metal planks with a wood grain finish, to the underside of the ceiling in spaced parallel relation, there is provided in accordance with the invention an elongated mounting device or clip 5 of generally C-shaped cross-section (see FIGS. 3 and 4) which is constructed so as to be easily yet firmly attached to grid member 1 of an installed ceiling and to be readily engaged by the decorative panels for mounting the latter in position, as shown in FIGS. 1 and 2. FIG. 2 shows the ceiling arrangement of FIG. 1 as viewed from the ends of parallel decorative panels 4. Grid member 3, omitted from FIG. 1 for purposes of clarity, constitutes a cross runner which intersects main grid runner 1 and is connected thereto by suitable means (not shown).

Clip 5, made typically of 20 gauge cold rolled steel, is formed with an upper arm 5*a* and a lower arm 5*b* connected by a bend or bight portion 5*c*. As seen best in FIG. 4, lower arm 5*b* is substantially wider than upper arm 5*a* and extends nearly to the outer edge of grid flange 1*b*, while upper arm 5*a* extends approximately the width of opposite grid flange 1*a*. The outer edge portion of upper arm 5*a* is bent upwardly somewhat to facilitate insertion of clip 5 on grid flange 1*a*. Lower arm 5*b* is formed with punched-out tabs 5*d*, 5*e* (see FIG. 3) extending downwardly therefrom and projecting in opposite directions. The pair of tabs 5*d*, 5*e* are constructed and arranged to be readily engaged by the opposite in-turned flanges 4*a*, 4*b* of a decorative panel 4 for holding the latter in position below and extending transverse grid member 1 on which mounting clip 5 is attached, the latter having a plurality of similar pairs of tabs spaced along its length for attaching additional panels 4 in parallel relation as seen in FIG. 1. As will be understood, other grid members (not shown) arranged parallel to and laterally spaced from grid member 1 will have mounting clips 5 similarly attached thereto for engaging panels 4 at other points spaced along their length for securely holding the panels in position on the underside of the installed ceiling.

To attach panel 4 to tabs 5*d*, 5*e*, the installer merely hooks flange 4*b* of panel 4 over tab 5*e*, applies horizontal pressure to panel 4 against the resilient force of tab 5*e* until flange 4*a* clears tab 4*d*, and then moving panel 4 upwardly allows flange 4*a* to snap into position over tab 5*d*.

Figure 4:
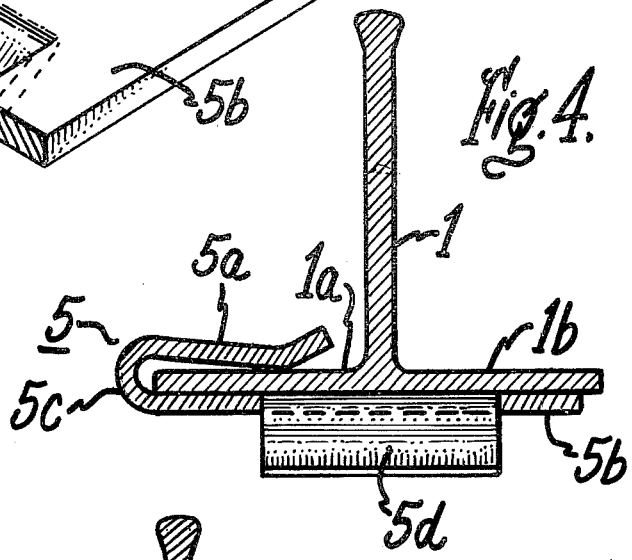
FIG. 4 is an end elevational view in enlarged scale of the mounting device attached to the ceiling grid member.
Figure 5:
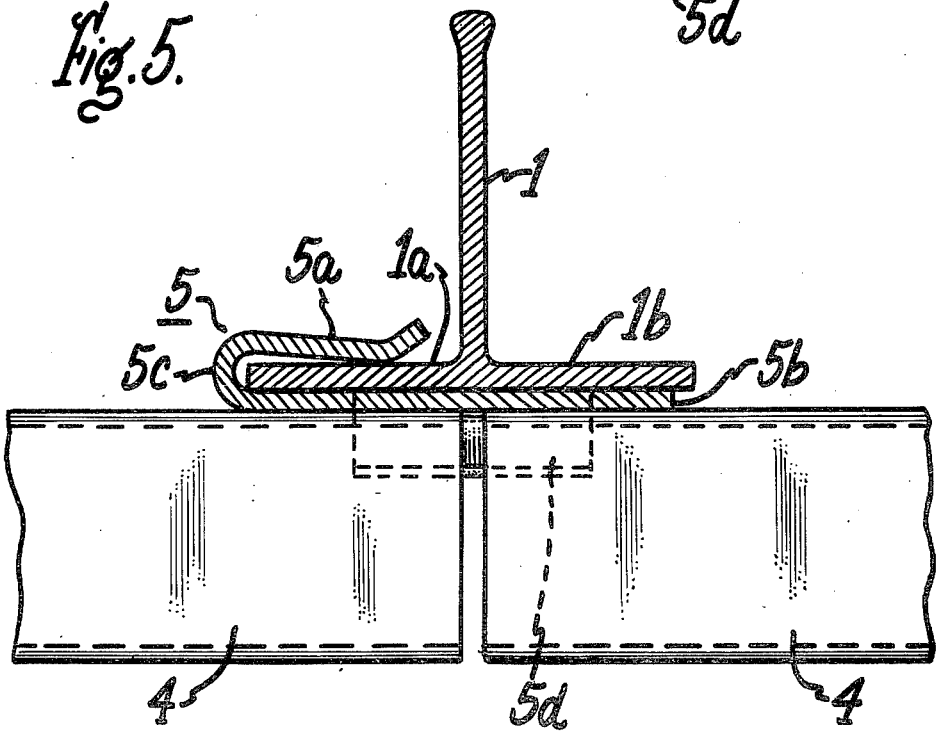
FIG. 5 is a view similar to FIG. 4 showing the mounting device holding adjoining decorative panels with ends in abutting relation.

As shown in FIG. 4, each of the tabs, e.g., tab 5*b*, is preferably made sufficiently wide so that it extends, when clipped onto grid member 1, from about the mid-point of flange 1*a* to about the mid-point of flange 1*b*. In this way, a pair of elongated panels 4 may be attached to mounting clip 5 in end-abutting relation with adjoining ends substantially aligned with the vertical web of grid member 1, as seen in FIG. 5. There is thus avoided the possibility of tilting grid member 1 such as might occur if the adjoining ends were not aligned with the web of grid member 1.

By virtue of the described adaptor clip, it is possible to attach decorative panels to already installed ceiling grid systems without interfering with light fixtures, air conditioning outlets or other equipment forming a part of such systems, inasmuch as the elongated mounting clip as well as the associated decorative panels can be readily tailored to appropriate lengths to avoid traversing such installed equipment by the attached clip and panels. Moreover, the described mounting clip may be attached not only to main grid runners but also to cross grid runners to provide various patterns of the decorative panels on the ceiling.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

I claim:

1. Mounting device for attaching elongated ceiling panels having opposite flanges directed toward each other to an installed ceiling grid system having elongated grid support members of inverted T-shape having a vertical web with oppositely directed horizontal bottom flanges, said device comprising an elongated clip member formed of a strip having a length greater than its width and being bent along one side so as to form an upper arm portion and a lower arm portion joined by a bight portion and adapted to engage one of the bottom flanges of a grid support member with the flange between said arm portions, said lower arm portion having a plurality of pairs of longitudinally spaced, depending tabs punched out therefrom along its length for attaching a plurality of elongated ceiling panels along the length of said clip member, the tabs in each pair extending in opposite directions away from each other for engaging the flanges of an elongated ceiling panel for holding the same below and extending transverse the grip support member.

2. A device as defined in claim 1, the lower arm portion being substantially wider than the upper arm portion for extending over most of the overall width of the bottom of the grid support member and being unbent along its outer edge portion.

3. A device as defined in claim 2, said tabs being arranged approximately centrally of the lateral dimension of said lower arm portion and being sufficiently wide to extend a substantial distance on opposite sides of the vertical web of the grid support member.

4. A device as defined in claim 2, the outer edge portion of said upper arm portion being upwardly bent to facilitate attachment of said clip member to the grid support member.

5. In a ceiling system having elongated grid support members of inverted T-shape formed with a vertical web and a horizontal bottom flange, a plurality of elongated decorative panels and mounting means attaching said panels in spaced parallel arrangement on the grid support members, said mounting means comprising an elongated clip member formed of a strip having a length greater than its width and being bent along one side so as to form an upper arm portion and a lower arm portion joined by a bight portion and engaging the bottom flange of a grid support member with the flange between said arm portions, said lower arm portion having a plurality of pairs of longitudinally spaced, depending tabs punched out therefrom along its length attaching said plurality of elongated ceiling panels along the length of said clip member, each pair of tabs engaging an elongated ceiling panel for holding the same below and extending transverse the grid support member.

6. A ceiling system as defined in claim 5, wherein said elongated ceiling panels each are formed with opposite flanges extending toward each other, the tabs in each pair extending in opposite directions away from each other and engaging the flanges of a respective one of said elongated ceiling panels.

7. A ceiling system as defined in claim 6, said lower arm portion being unbent along its outer edge portion.

* * * * *